US007307538B2

(12) United States Patent
Kochan, Jr.

(10) Patent No.: US 7,307,538 B2
(45) Date of Patent: Dec. 11, 2007

(54) PUMP CONNECTOR SYSTEM

(75) Inventor: John R. Kochan, Jr., Naperville, IL (US)

(73) Assignee: Metropolitan Industries, Inc., Romeoville, IL (US)

( * ) Notice: Subject to any disclaimer, the term of this patent is extended or adjusted under 35 U.S.C. 154(b) by 211 days.

(21) Appl. No.: 11/100,219

(22) Filed: Apr. 6, 2005

(65) Prior Publication Data

US 2006/0226997 A1 Oct. 12, 2006

(51) Int. Cl.
*G08B 21/00* (2006.01)

(52) U.S. Cl. ..... 340/618; 340/612; 340/616; 340/623; 361/752; 417/14

(58) Field of Classification Search ..... 340/604, 340/605, 612, 616, 618, 620, 623, 679; 361/752, 361/756, 775; 417/14, 40, 63
See application file for complete search history.

(56) References Cited

U.S. PATENT DOCUMENTS

| | | | | |
|---|---|---|---|---|
| 4,222,711 | A * | 9/1980 | Mayer | 417/7 |
| 4,369,438 | A * | 1/1983 | Wilhelmi | 340/623 |
| 5,071,370 | A | 12/1991 | Kochan, Jr. | |
| 5,125,247 | A * | 6/1992 | Mills | 68/208 |
| 5,449,274 | A * | 9/1995 | Kochan, Jr. | 417/8 |
| 5,696,493 | A * | 12/1997 | Einck | 340/623 |
| 6,322,325 | B1 | 11/2001 | Belehradek | |
| 6,462,666 | B1 * | 10/2002 | Einck | 340/623 |
| 2002/0076331 | A1 * | 6/2002 | Eckert et al. | 417/40 |
| 2003/0048191 | A1 * | 3/2003 | Denton | 340/616 |

* cited by examiner

*Primary Examiner*—Brent A. Swarthout
(74) *Attorney, Agent, or Firm*—Welsh & Katz, Ltd.

(57) ABSTRACT

A single pump control unit can be coupled to first and second float switches and a pump for purposes of removing fluid from a region such as a sump. A supplemental set of contacts can be provided to couple an alarm indicating signal to a remote alarm. An alarm state can also be transmitted wirelessly.

4 Claims, 1 Drawing Sheet

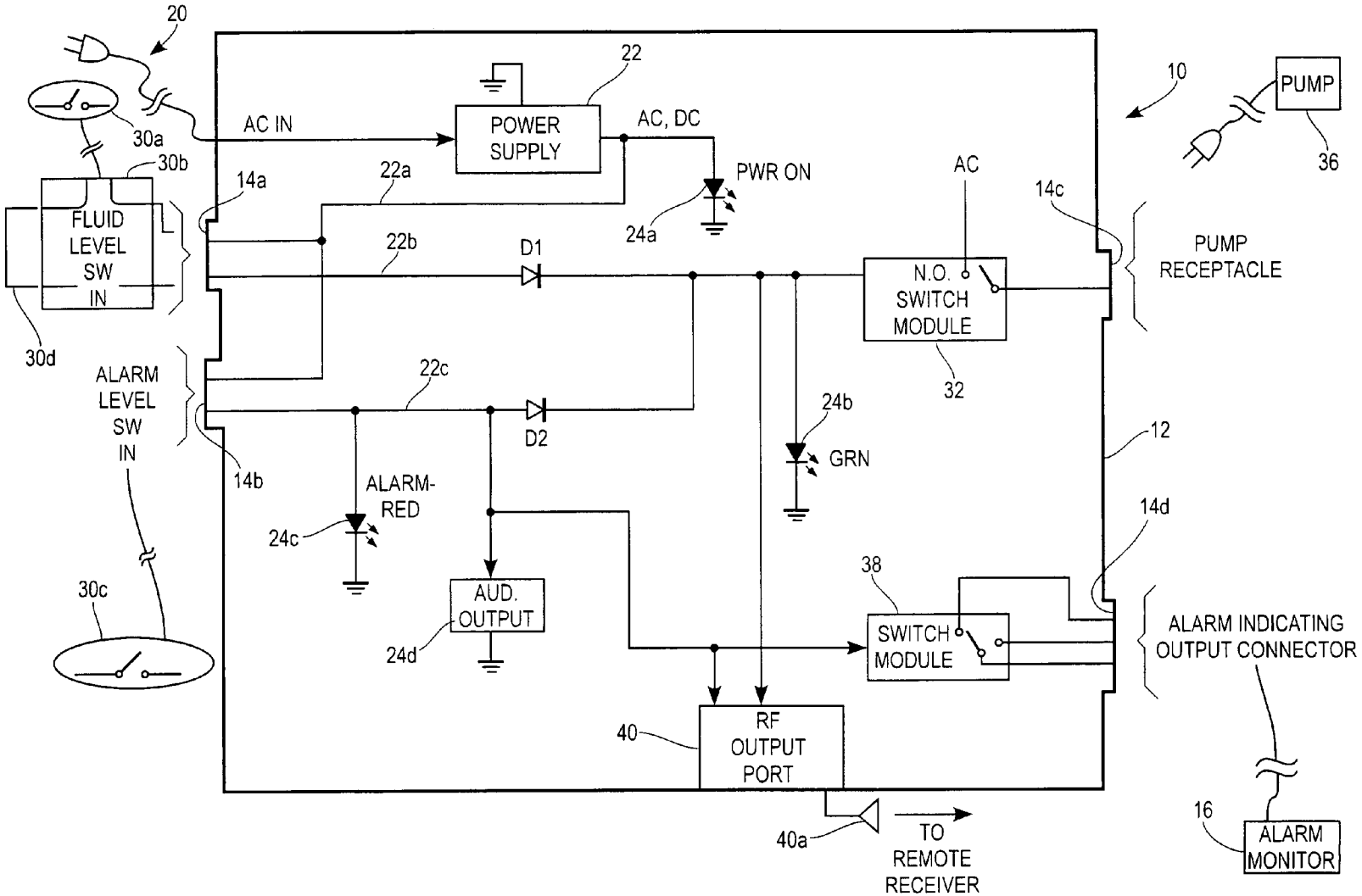
PUMP
36
10
PUMP RECEPTACLE
14c
12
14d
ALARM INDICATING OUTPUT CONNECTOR
ALARM MONITOR
16
AC
N.O. SWITCH MODULE
32
SWITCH MODULE
38
TO REMOTE RECEIVER
40a
24b
GRN
PWR ON
24a
AC, DC
22
POWER SUPPLY
RF OUTPUT PORT
40
D1
D2
AUD. OUTPUT
24d
22c
22a
22b
ALARM-RED
24c
AC IN
14a
14b
20
30a
30b
FLUID LEVEL SW IN
ALARM LEVEL SW IN
30c
30d

PUMP CONNECTOR SYSTEM

FIELD OF THE INVENTION

The invention pertains to control units for pumps.

BACKGROUND OF THE INVENTION

Control units for use with various types of fluid pumps, for example, sump pumps, are known. One such system has been disclosed in Kochan, Jr. U.S. Pat. No. 5,449,274 entitled "Sump System Having Timed Switching of Plural Pumps" which issued Sep. 12, 1995. The '274 patent is owned by the assignee hereof and is incorporated herein by reference.

The system of the '274 patent provides for alternating control of first and second different pumps. Not all installations need multiple pumps.

In another configuration, float switches are known which have a so-called piggy-back plug. The plug includes a socket for a plug for a pump motor. The float switch is in series with the motor. When the float indicates high water the float switch closes and the motor is energized. Pumping continues until the level falls enough to open circuit the switch.

While the above configuration is simple, the float switch is subject to full motor current, including start-up currents as well as arcing. Further, there is no convenient way to incorporate a back-up, high water float, or to energize displaced alarms.

There continues to be a need for control devices which can be used with a single pump. Preferably, such units would be readily connectable to respective pumps and float switches. It would also be preferable if such units could take advantage of float switches which incorporate piggy-back plugs of a standard variety while at the same time minimizing float switch currents and arcing.

Preferably any such connections would be readily changeable for maintenance purposes in the event that either the pump or the associated float switch failed. It would also be desirable to be able to provide remote indications as to the presence of an alarm condition.

BRIEF DESCRIPTION OF THE DRAWINGS

FIG. 1 is a block diagram of a pump control unit in accordance with the present invention.

DETAILED DESCRIPTION OF THE EMBODIMENTS

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Pump control units which embody the present invention can be used with any appropriately sized pump and with a switch having a piggy-back plug. As those of skill in the art understand, in such configurations, the pump motor and switch cable are separate from one another.

A pump control unit which embodies the present invention incorporates a housing. The housing carries a fluid level indicating switch receptacle, an alarm switch receptacle, a pump receptacle and an alarm indicating output receptacle. The unit can be energized by locally available AC power.

Switches which incorporate piggy-back plugs are readily connectable to the float switch receptacle. A jumper can be connected to a receptacle end of the piggy-back switch.

An AC plug coupled to the pump can be plugged into the pump receptacle. If desired, an alarm or monitoring unit can be plugged into the alarm indicating output receptacle. Visual and audible status indicators can also be provided on the unit.

The present control unit can be used with any switch that is effective to indicate a fluid level. These include but are not limited to pressure switches, float switches, vertical switches, solid state switches, ultrasonic based switches, all without limitation.

An optional RF output port can be included in the unit. The RF output port can wirelessly transmit status information such as normal or alarm to a remote receiver.

FIG. 1 illustrates a pump control unit 10 in accordance with the invention. The unit 10 includes a housing 12, which might be wall mountable. Housing 12 carries a plurality of connectors, which could be implemented as standard AC-type receptacles.

The connectors include connector 14*a* to which can be coupled a piggy-back-type switch plug. A second connector 14*b* can be used to couple an alarm switch to the unit 10. As noted above, unit 10 can be used with a variety of fluid level indicating switches.

Output connector or receptacle 14*c* can be used to provide electrical energy to a pump via a standard AC-type plug. Output connector or receptacle 14*d* can be used to couple an electrical state, normally open, normally closed, of a switchable output device to a remote alarm or monitor 16.

Electrical energy can be provided to the unit 10 via a standard AC-type plug and cord 20. Electrical energy received from the plug and cord 20 can be used in part to energize a power supply, for example, a 12 volt AC or DC power supply 22.

One output from the supply 22 can be used to energize a "power on" indicating light emitting diode 24*a*. The output from the supply 22 can be coupled to contacts on connectors or receptacles 14*a, b* via line 22*a*. Electrical signals in the form of relatively low voltage or a low current from supply 22 via line 22*a* can be coupled via connector 14*a* to a level indicating switch 30*a* via a piggy-back connector/receptacle 30*b*. Feedback, a voltage or current can be coupled via line 22*b*, in response to a normally closed switch 30*a* to a switch module 32.

The switch module 32 whose outputs can switch utility supplied AC received via plug and cord 20 can be used to couple electrical energy to pump receptacle 14*c* to energize pump 36 in response to a switch closure at the switch 30*a*. Simultaneously, status indicator 24*b* can be energized to emit output light indicative of normal operation of the pump 36.

Alternately, in the event of a failure of the primary pump switch 30*a*, if the alarm level switch 30*c* is closed (or opened) due to the high water, electrical signals via line 22*a* can be coupled via line 22*c* through an isolation diode D2 to cause the switch module 32 to change state and activate pump 36. Simultaneously, alarm indicating visual indicators, such as light emitting diode 24*c* or audible alarm indicating output 24*d* could be activated.

The unit 10 will continue to energize the pump 36 until either or both the alarm indicating switch 30*c* or normal level indicating switch 30*a* return to their unactivated states.

When the alarm indicating signal is coupled via line 22*c* to the switch module 32, it can also be simultaneously coupled to an alarm indicating output switch module 38. The switch modules 32, 38 could be implemented as electromechanical or solid state switches that can provide normally closed, normally opened output contacts via connector 14*c, d* to energize pump 36 or to indicate an alarm condition to the remote alarm or monitor 16.

RF output port 40 can be provided with an appropriate antenna 40*a* to wirelessly communicate alarm conditions via a remote receiver.

To take advantage of the configuration of the piggy-back switch receptacle/plug 30*b* a jumper 30*d* can be provided and coupled thereto to complete the circuit between lines 22*a, b* when the switch 30*a* has changed state and gone from an open circuit condition to a closed circuit condition (or vice versa). As those of skill in the art will understand, unit 10 limits the current and voltage coupled to float switches 30*a, c*. For example, output voltage from supply 22 can be limited to 12 volts AC or DC with currents limited to milli-amps. In addition, motor start-up currents do not flow through switches 30*a, c*. They flow through power output contacts of switch modules 32, 38. These circuit configurations should not only promote longer operating lives for the switches such as 30*a, c*, but they provide additional operational flexibility for the user.

If desired, a battery back-up can be provided for the power supply 22. It will also be understood that the control circuits of unit 10 could be implemented, at least in part, with a programmed processor and associated control software.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A pump control device comprising:

a pump output connector;

an alarm output connector;

a fluid level switch connector;

an alarm switch connector;

control circuitry responsive to a signal from at least the alarm connector to couple electrical energy to the pump output connector and to the alarm output connector;

a housing which carries the connectors and the circuitry;

first and second switching circuits, each switching circuit coupled between the control circuitry and one of the output connectors; and a conductive element having first and second free ends and engageable with a portion of the fluid level switch conductor to couple an electrical signal through a level indicating switch to the switch connector, wherein one switching circuit responds only to a signal from the alarm switch connector while the other responds to signals from either of the fluid level indicating switch connector or the alarm switch connector.

2. A device as in claim 1 where the one switching circuit causes an electrical change of state at the alarm output connector at about the same time that an alarm indicator, carried by the housing is activated to indicate an alarm condition.

3. A pump control device comprising:

a pump output connector;

an alarm output connector;

a fluid level switch connector;

an alarm switch connector;

control circuitry responsive to a signal from at least the alarm connector to couple electrical energy to the pump output connector and to the alarm output connector;

a housing which carries the connectors and the circuitry; and first and second switching circuits, each switching circuit coupled between the control circuitry and one of the output connectors, wherein one switching circuit responds only to a signal from the alarm switch connector while the other responds to signals from either of the fluid level indicating switch connector or the alarm switch connector.

4. A device as in claim 3 where the one switching circuit causes an electrical change of state at the alarm output connector at about the same time that an alarm indicator, carried by the housing is activated to indicate an alarm condition.

* * * * *